US009738474B2

(12) United States Patent
Koizumi et al.

(10) Patent No.: US 9,738,474 B2
(45) Date of Patent: Aug. 22, 2017

(54) ORIENTATION CORRECTING DEVICE AND IMAGE FORMING APPARATUS

(71) Applicant: FUJI XEROX CO., LTD., Tokyo (JP)

(72) Inventors: Takehiko Koizumi, Kanagawa (JP); Takuyoshi Kimura, Kanagawa (JP); Hiroyuki Momiyama, Kanagawa (JP); Ryuga Oishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/827,405

(22) Filed: Aug. 17, 2015

(65) Prior Publication Data

US 2016/0280487 A1 Sep. 29, 2016

(30) Foreign Application Priority Data

Mar. 26, 2015 (JP) ..... 2015-065217

(51) Int. Cl.
*B65H 9/06* (2006.01)
*B65H 9/00* (2006.01)
(Continued)

(52) U.S. Cl.
CPC ..... *B65H 9/006* (2013.01); *B65H 7/08* (2013.01); *B65H 7/10* (2013.01); *B65H 9/20* (2013.01); *B65H 2301/331* (2013.01); *B65H 2301/3613* (2013.01); *B65H 2404/1424* (2013.01); *B65H 2511/222* (2013.01); *B65H 2511/242* (2013.01); *B65H 2511/416* (2013.01);
(Continued)

(58) Field of Classification Search
CPC ..... B65H 9/004; B65H 9/006; B65H 9/10; B65H 7/08; B65H 7/10; B65H 2301/331; B65H 2301/3613; B65H 2404/1424; B65H 2404/1523; B65H 2511/242
See application file for complete search history.

(56) References Cited

U.S. PATENT DOCUMENTS 5,219,159 A * 6/1993 Malachowski ..... B65H 9/002 271/228
6,135,446 A * 10/2000 Thiemann ..... B65H 7/10 271/228
(Continued)

FOREIGN PATENT DOCUMENTS

JP 2001-039584 A 2/2001
JP 2003-20137 A 1/2003

*Primary Examiner* — Ernesto Suarez
(74) *Attorney, Agent, or Firm* — Sughrue Mion, PLLC

(57) ABSTRACT

An orientation correcting device includes a first transporting unit that nips and transports a sheet; a detecting unit that detects a tilt of the sheet that is transported by the first transporting unit; a second transporting unit that nips and transports the sheet that has been transported by the first transporting unit; a flexure forming unit that, with the second transporting unit stopped, forms a flexure in the sheet as a result of causing the sheet that is transported by the first transporting unit to strike against the second transporting unit; and a moving unit that, with the second transporting unit stopped and the flexure formed in the sheet by the flexure forming unit, moves the second transporting unit in a crossing direction that crosses a transport direction of the sheet in accordance with an amount and a direction of the sheet tilt detected by the detecting unit.

9 Claims, 12 Drawing Sheets

(51) Int. Cl.
*B65H 9/20* (2006.01)
*B65H 7/10* (2006.01)
*B65H 7/08* (2006.01)

(52) U.S. Cl.
CPC ..... *B65H 2513/53* (2013.01); *B65H 2557/23* (2013.01); *B65H 2701/1311* (2013.01); *B65H 2801/06* (2013.01)

(56) References Cited

U.S. PATENT DOCUMENTS

| | | | | |
|---|---|---|---|---|
| 7,677,558 | B2 * | 3/2010 | Kinoshita | B65H 9/002 271/227 |
| 8,342,517 | B2 * | 1/2013 | Kinoshita | B65H 9/002 271/226 |
| 8,678,382 | B2 * | 3/2014 | Deno | B65H 7/00 271/228 |
| 8,820,738 | B2 * | 9/2014 | Deno | B65H 9/00 271/228 |
| 2012/0286468 | A1 * | 11/2012 | Ui | B65H 7/06 271/228 |
| 2013/0009358 | A1 * | 1/2013 | Deno | B65H 7/08 271/227 |

* cited by examiner

ORIENTATION CORRECTING DEVICE AND IMAGE FORMING APPARATUS

CROSS-REFERENCE TO RELATED APPLICATIONS

This application is based on and claims priority under 35 USC 119 from Japanese Patent Application No. 2015-065217 filed Mar. 26, 2015.

BACKGROUND

Technical Field

The present invention relates to an orientation correcting device and an image forming apparatus.

SUMMARY

According to an aspect of the invention, there is provided an orientation correcting device including a first transporting unit that nips and transports a sheet; a detecting unit that detects a tilt of the sheet that is transported by the first transporting unit; a second transporting unit that, at a location that is downstream from the first transporting unit in a transport direction of the sheet, nips and transports the sheet that has been transported by the first transporting unit; a flexure forming unit that, with the second transporting unit stopped, forms a flexure in the sheet as a result of causing the sheet that is transported by the first transporting unit to strike against the second transporting unit; and a moving unit that, with the second transporting unit stopped and the flexure formed in the sheet by the flexure forming unit, moves the second transporting unit in a crossing direction that crosses the transport direction of the sheet in accordance with an amount and a direction of the sheet tilt detected by the detecting unit.

BRIEF DESCRIPTION OF THE DRAWINGS

Exemplary embodiments of the present invention will be described in detail based on the following figures, wherein.

DETAILED DESCRIPTION

Exemplary embodiments of the present invention are hereunder described in detail with reference to the attached drawings.

First Exemplary Embodiment

Figure 1:
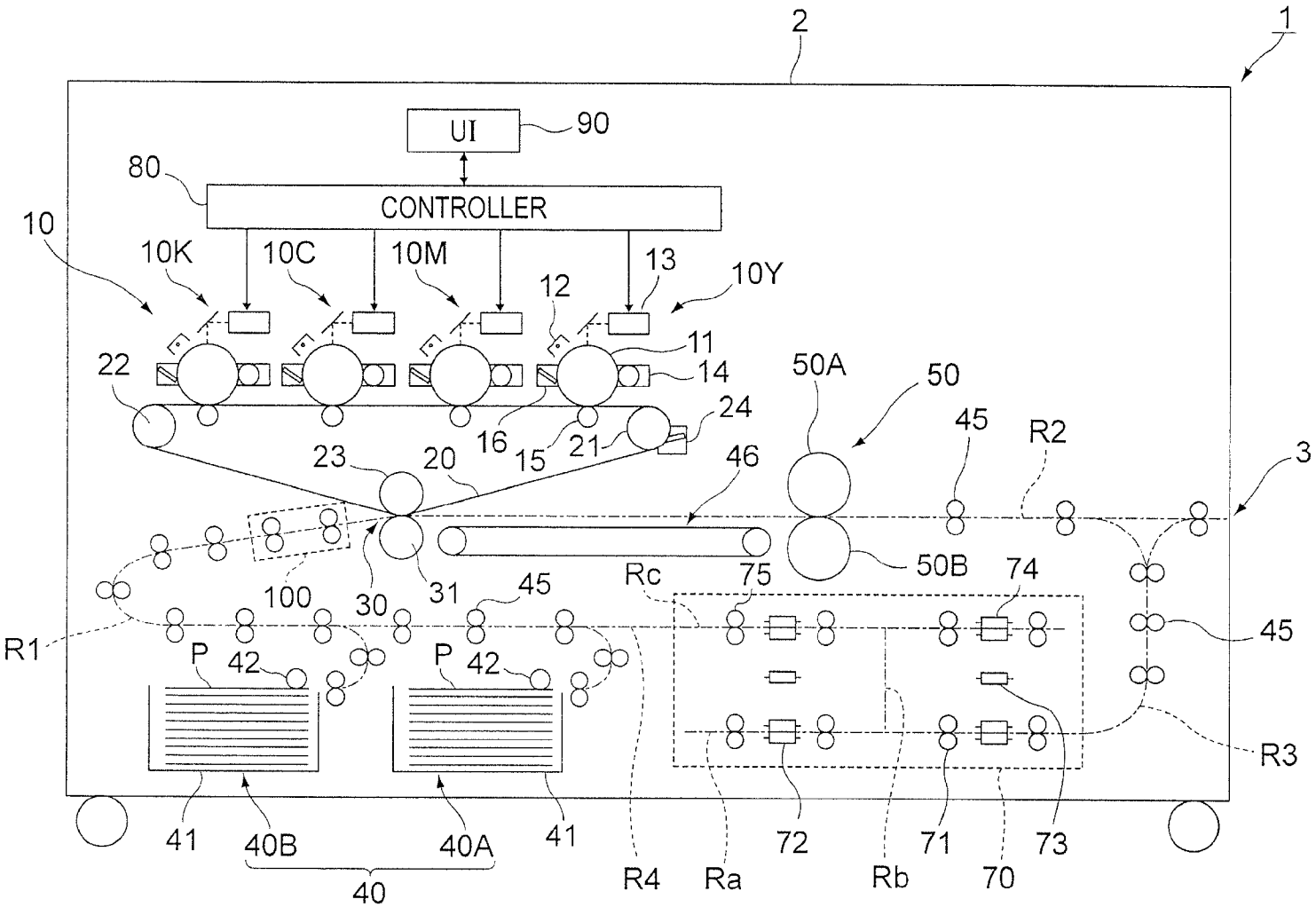
FIG. 1 illustrates an exemplary overall structure of an image forming apparatus.

FIG. 1 illustrates an exemplary overall structure of an image forming apparatus 1 to which an exemplary embodiment is applied. Here, FIG. 1 is a front sectional view of a structure of the image forming apparatus 1.

The image forming apparatus 1 includes an image forming section 10, an intermediate transfer belt 20, and a second transfer device 30. The image forming section 10 forms images. The images formed by the image forming section 10 are first-transferred to the intermediate transfer belt 20. The second transfer device 30 second-transfers the images first-transferred to the intermediate transfer belt 20 to a sheet P. The image forming apparatus 1 also includes a sheet supplying device 40 and a fixing device 50. The sheet supplying device 40 supplies a sheet P towards the second transfer device 30. The fixing device 50 fixes the images second-transferred to the sheet P by the second transfer device 30. The image forming apparatus 1 further includes an orientation correcting device 100 and a reverse transporting device 70. The orientation correcting device 100 corrects the orientation of the sheet P that is transported towards the second transfer device 30. The reverse transporting device 70 reverses the front and back of the sheet P that has passed through the fixing device 50 and transports towards the orientation correcting device 100 the sheet P whose front and back have been reversed. The image forming apparatus 1 still further includes a controller 80 and a user interface (UI) 90. The controller 80 controls the operation of each of the aforementioned devices. The user interface 90 includes a touch panel or the like, outputs an instruction received from a user to the controller 80, and provides the user with information from the controller 80. The image forming apparatus 1 according to the exemplary embodiment includes a housing 2 that accommodates each of the aforementioned devices in the interior of the image forming apparatus 1.

A first transport path R1, a second transport path R2, a third transport path R3, and a fourth transport path R4 are provided in the image forming apparatus 1. A sheet P that is transported towards the second transfer device 30 from the sheet supplying device 40 passes through the first transport path R1. The sheet P that has passed through the second transfer device 30 passes through the second transport path R2. The third transport path R3 is branched from the second transport path R2 and extends to a location that is situated below the first transport path R1 at a location situated downstream from the fixing device 50, and guides the sheet P to the reverse transporting device 70. The fourth transport path R4 guides the sheet P that has passed through the reverse transporting device 70 to the first transport path R1 again. An end portion of the second transport path R2 at a downstream side in a transport direction of the sheet P is connected to an opening 3 that is formed in the housing 2.

The image forming apparatus 1 according to the exemplary embodiment performs what is called a "center reference" operation in which sheets P of different sizes are transported with central positions of the sheets P in a direction (width direction) that is orthogonal to the transport direction of the sheets P serving as references.

Of the devices, the image forming section 10, serving as an exemplary image forming device, includes image forming units 10Y, 10M, 10C, and 10K that form toner images including corresponding color components by an electrophotographic system. The image forming units 10Y, 10M, 10C, and 10K are disposed side by side so as to oppose the intermediate transfer belt 20. Here, the image forming unit 10Y forms a yellow image, the image forming unit 10M forms a magenta image, the image forming unit 10C forms a cyan image, and the image forming unit 10K forms a black image.

The image forming units 10Y, 10M, 10C, and 10K each include a rotatably mounted photoconductor drum 11. In each of the image forming units 10Y, 10M, 10C, and 10K, a charging device 12, an exposure device 13, a developing device 14, a first transfer device 15, and a drum cleaning device 16 are provided around the photoconductor drum 11. Here, each charging device 12 charges its corresponding photoconductor drum 11. Each exposure device 13 exposes its corresponding photoconductor drum 11 to form an electrostatic latent image thereon. Further, each developing device 14 makes visible the electrostatic latent image on its corresponding photoconductor drum 11 by using toner of a corresponding color. Still further, each first transfer device 15 transfers to the intermediate transfer belt 20 the toner image including the corresponding color component formed on the corresponding photoconductor drum 11. Each drum cleaning device 16 removes any residual toner on its corresponding photoconductor drum 11.

Next, the intermediate transfer belt 20 is placed upon three roller members 21 to 23 that are rotatably provided. Here, the roller member 22 is used to drive the intermediate transfer belt 20. The roller member 23 is disposed so as to oppose the second transfer roller 31 with the intermediate transfer belt 20 being interposed therebetween. The second transfer roller 31 and the roller member 23 form the second transfer device 30. A belt cleaning device 24 that removes any residual toner on the intermediate transfer belt 20 is provided so as to oppose the roller member 21 with the intermediate transfer belt 20 being interposed therebetween.

The sheet supplying device 40 includes a first sheet supplying device 40A and a second sheet supplying device 40B. The first sheet supplying device 40A supplies a sheet P to the first transport path R1. The second sheet supplying device 40B is provided downstream from the first sheet supplying device 40A in the transport direction of a sheet P, and supplies a sheet P to the first transport path R1. Here, the first sheet supplying device 40A and the second sheet supplying device 40B have a common structure. To be more specific, the first sheet supplying device 40A and the second sheet supplying device 40B each include a sheet holding unit 41 that holds sheets P and a take-out roller 42 that takes out and transports the sheets P held by the sheet holding unit 41.

The image forming apparatus 1 includes transport rollers 45 that are provided in each of the first transport path R1 to the fourth transport path R4. The transport rollers 45 nip and transport a sheet P that exists in the transport paths. The image forming apparatus 1 includes a belt transporting unit 46 that is disposed between the second transfer device 30 and the fixing device 50 in the second transport path R2. A sheet P that exists in this region is placed upon and transported by the belt transporting unit 46.

The fixing device 50 includes a heating roller 50A and a pressing roller 50B. The heating roller 50A is heated by a heater (not shown) that is installed therein. The pressing roller 50B is disposed so as to oppose the heating roller 50A with the second transport path R2 being interposed therebetween, and presses the heating roller 50A.

The reverse transporting device 70 includes a transport-in path Ra, a reverse path Rb, and a transport-out path Rc. Here, the transport-in path Ra communicates with the third transfer path R3 and allows a sheet P to be transported into the reverse transporting device 70 from the third transport path R3. The reverse path Rb communicates with the transport-in path Ra and allows the front and back of the sheet P to be reversed while the sheet P is being transported through the reverse path Rb. The transport-out path Rc communicates with the reverse path Rb and the fourth transport path R4, provided in the image forming apparatus 1, and allows the sheet P whose front and back have been reversed to be transported out to the fourth transport path R4. In the reverse transporting device 70, the transport-out path Rc is disposed directly above the transport-in path Ra as viewed from the top. The reverse transport path Rb is curved in a U shape at a near-side location of the transport-in path Ra and the transport-out path Rc, so that the reverse path Rb is disposed so as to connect a near side of the transport-in path Ra and a near side of the transport-out path Rc. The reverse transporting device 70 also includes transport-in rollers 71, a first reverse roller 72, a second reverse roller 73, a third reverse roller 74, and transport-out rollers 75. Here, the transport-in rollers 71 transport through the transport-in path Ra the sheet P transported from the third transport path R3. The first reverse roller 72 transports the sheet P transported into the transport-in path Ra through the transport-in path Ra and towards the reverse path Rb. The second reverse roller 73 transports the sheet P that has been transported into the reverse path Rb through the reverse path Rb and towards the transport-out path Rc. The third reverse roller 74 transports through the transport-out path Rc the sheet P transported from the reverse transport path Rb. The transport-out rollers 75 transport the sheet P that has been transported into the transport-out path Rc through the transport-out path Rc and towards the fourth transport path R4.

An image formation operation that is performed by using the image forming apparatus 1 shown in FIG. 1 is described.

When image information is received from an external device (not shown), the controller 80 produces exposure data based on the image information and outputs the exposure data to each exposure device 13 of the image forming section 10, or outputs an operation start control signal to each portion of the image forming apparatus 1.

For example, in the image forming unit 20Y for yellow (Y), the photoconductor drum 11 that is rotationally driven is charged by the charging device 12, and is exposed by the exposure device 13 that emits light on the basis of the exposure data supplied from the controller 80. This causes an electrostatic latent image related to a yellow image to be formed on the photoconductor drum 11. The electrostatic latent image formed on the photoconductor drum 11 is developed by the developing device 14 to form a yellow toner image on the photoconductor drum 11. Similarly, in the other image forming units 10M, 10C, and 10K, a magenta (M) toner image, a cyan (C) toner image, and a black (K) toner image are formed, respectively, by the above-described procedure.

The toner images formed on the photoconductor drums 11 of the respective image forming units 10Y, 10M, 10C, and 10K are first-transferred (electrostatically transferred) to the rotationally driven intermediate transfer belt 20 by the first transfer devices 15 that are provided for the respective toner images, and are superposed upon on each other on the intermediate transfer belt 20. A superposed toner image formed by superposing the toner images upon each other on the intermediate transfer belt 20 is moved towards a second transfer position, where the second transfer device 30 is provided, by the rotation of the intermediate transfer belt 20. Any residual toner remaining on the photoconductor drums 11 after the first transfer is removed by the drum cleaning devices 16 of the corresponding image forming units 10Y, 10M, 10C, and 10K.

In the sheet supplying device 40, sheets P that are held by the sheet holding unit 41 of the first sheet supplying device 40A (or the second sheet supplying device 40B) are taken out one by one by using the take-out roller 42, and are transported out to the first transport path R1. Then, the orientation correcting device 100, which is provided at the first transport path R1, corrects the orientations (tilts, positions, etc.) of the sheets P that have been transported from the sheet supplying device 40, and transports out the sheets P towards the second transfer position in accordance with the timing in which the superposed toner image on the intermediate transfer belt 20 reaches the second transfer position.

The superposed toner image on the intermediate transfer belt 20 is second-transferred (electrostatically transferred) to the sheet P that passes the second transfer position by the second transfer device 30. At this time, the second transfer of the superposed toner image is performed on a surface (first surface) of the sheet P that opposes the intermediate transfer belt 20.

Then, the sheet P to which the superposed toner image has been transferred as a result of passing the second transfer position is transported through the second transport path R2 and passes through the fixing device 50. At this time, the first surface, which is a transfer surface of the superposed toner image, of the sheet P is heated by the heating roller 50A, and the sheet P is pressed by the heating roller 50A and the pressing roller 50B. By this, the superposed toner image is fixed to the sheet P. Thereafter, the sheet P to which the superposed toner image has been fixed is discharged out of the image forming apparatus 1 from the second transport path R2 via the opening 3. Any residual toner on the intermediate transfer belt 20 after the superposed toner image has passed the second transfer position is removed by the belt cleaning device 24.

On the other hand, when images are to be formed on both surfaces of the sheet P, the sheet P that has passed through the fixing device 50 is caused to enter the third transport path R3 from the second transport path R2, and to enter the reverse transporting device 70 from the third transport path R3. In the reverse transporting device 70, an operation for reversing the front and back of the sheet P that is being transported is performed, and the sheet P that is being discharged from the reverse transporting device 70 to the fourth transport path R4 is in a state in which its front and back are reversed compared to the state prior to entering the reverse transporting device 70.

In the image forming section 10, the toner images of the corresponding colors are formed by the above-described procedure, and the toner images of the corresponding colors are formed into a superposed toner image by the transfer of the toner images to the intermediate transfer belt 20. The superposed toner image moves towards the second transfer position.

On the other hand, the sheet P whose front and back have been reversed by the reverse transporting device 70 re-enters the first transport path R1 from the fourth transport path R4, and reaches the orientation correcting device 100 again. Then, the orientation correcting device 100 corrects the orientation of the sheet P transported from the reverse transporting device 70, and transports out the sheet P to the second transfer position in accordance with the timing in which the superposed toner image on the intermediate transfer belt 20 reaches the second transfer position.

The superposed toner image on the intermediate transfer belt 20 is second-transferred (electrostatically transferred) to the sheet P that passes the second transfer position by the second transfer device 30. At this time, the second transfer of the superposed toner image is performed on a surface (second surface) of the sheet P that opposes the intermediate transfer belt 20.

Then, the sheet P to which the superposed toner image has been transferred as a result of passing the second transfer position is transported through the second transport path R2, and passes through the fixing device 50. At this time, the second surface, which is a transfer surface of the superposed toner image, of the sheet P is heated by the heating roller 50A, and the sheet P is pressed by the heating roller 50A and the pressing roller 50B. By this, the superposed toner image is fixed to the sheet P. Thereafter, the sheet P to whose both surfaces the superposed toner images have been fixed as a result of passing through the fixing device 50 is discharged out of the image forming apparatus 1 from the second transport path R2 via the opening 3. Any residual toner on the intermediate transfer belt 20 after the superposed toner image has passed the second transfer position is removed by the belt cleaning device 24. This causes an image to be formed not only on the first surface of the sheet P, but also on the second surface of the sheet P.

Next, a structure of the orientation correcting device 100 of the image forming apparatus 1 is described.

Figure 2:
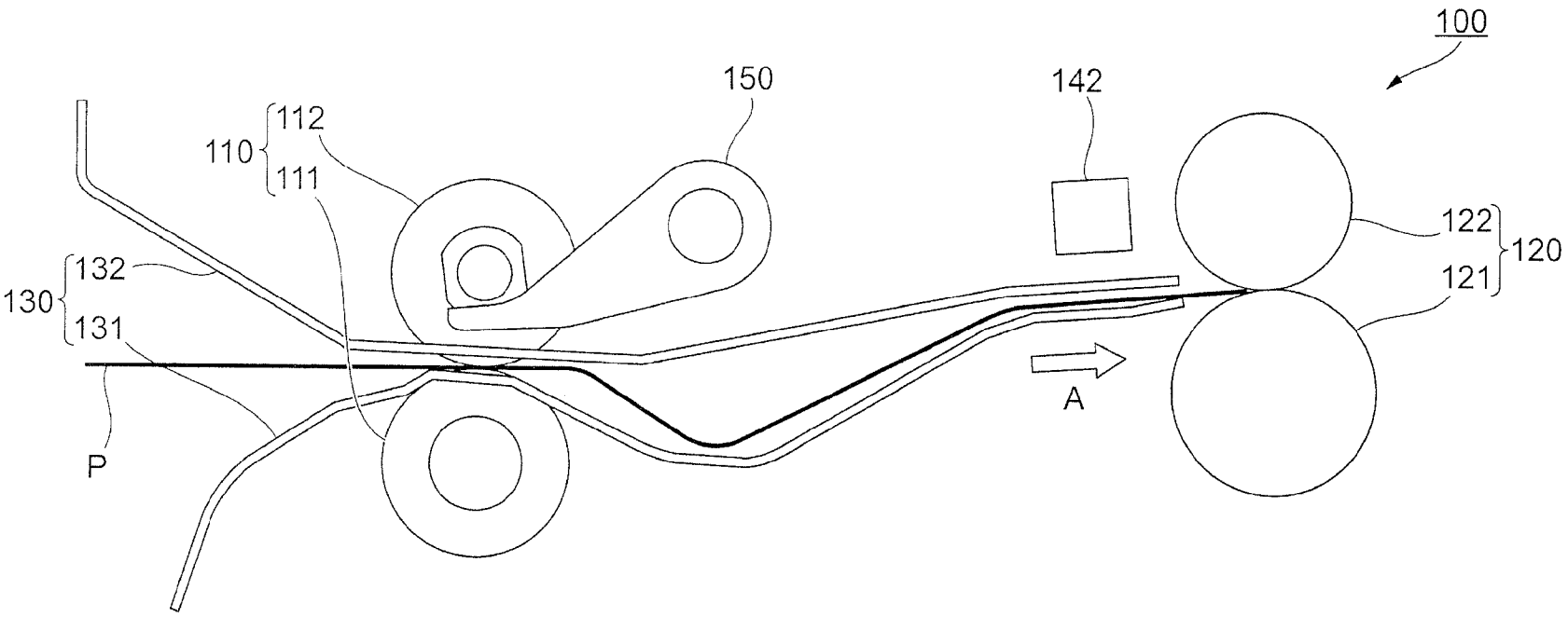
FIG. 2 is a side view of an orientation correcting device.
Figure 3:
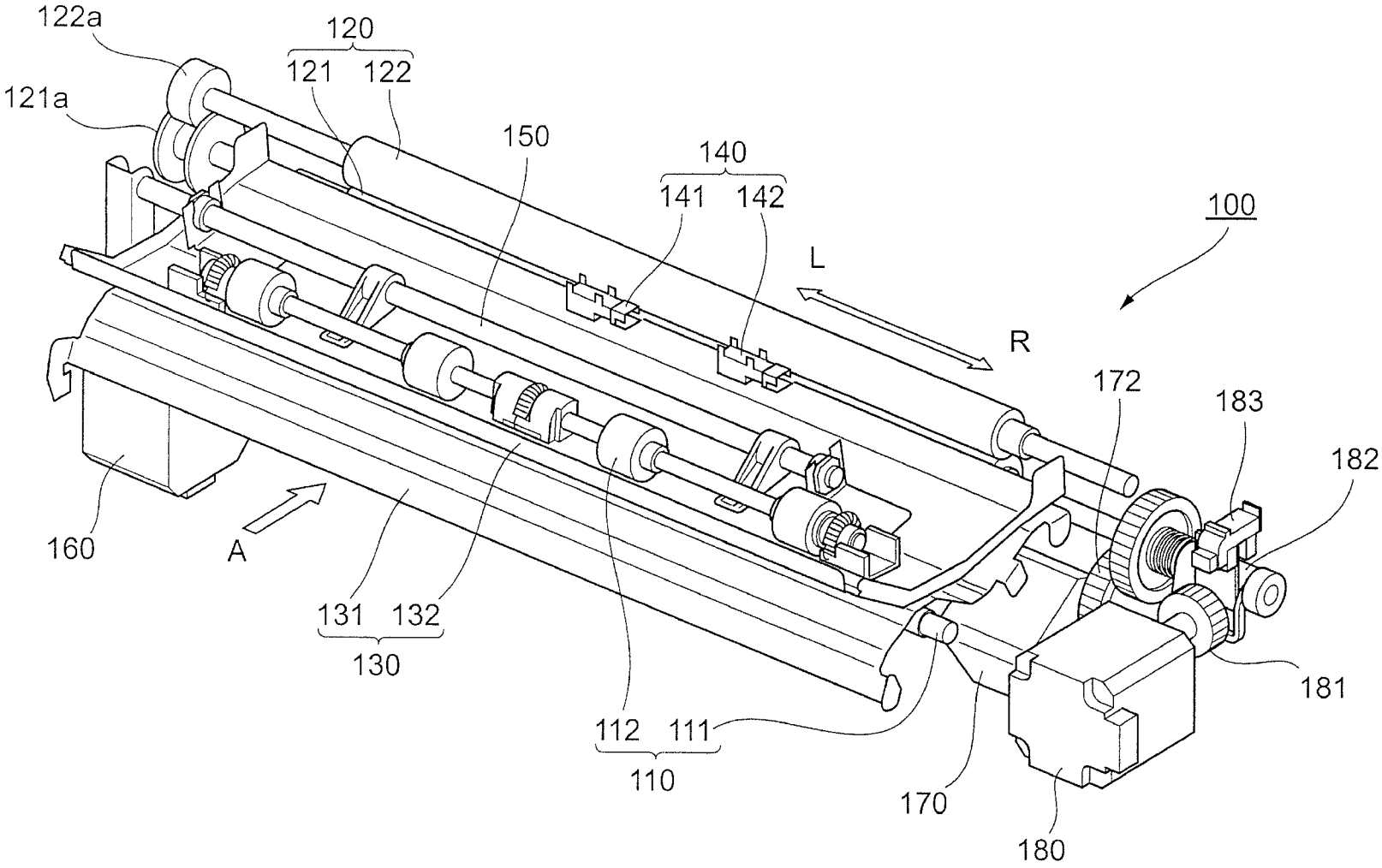
FIG. 3 is a perspective view of the orientation correcting device.
Figure 4:
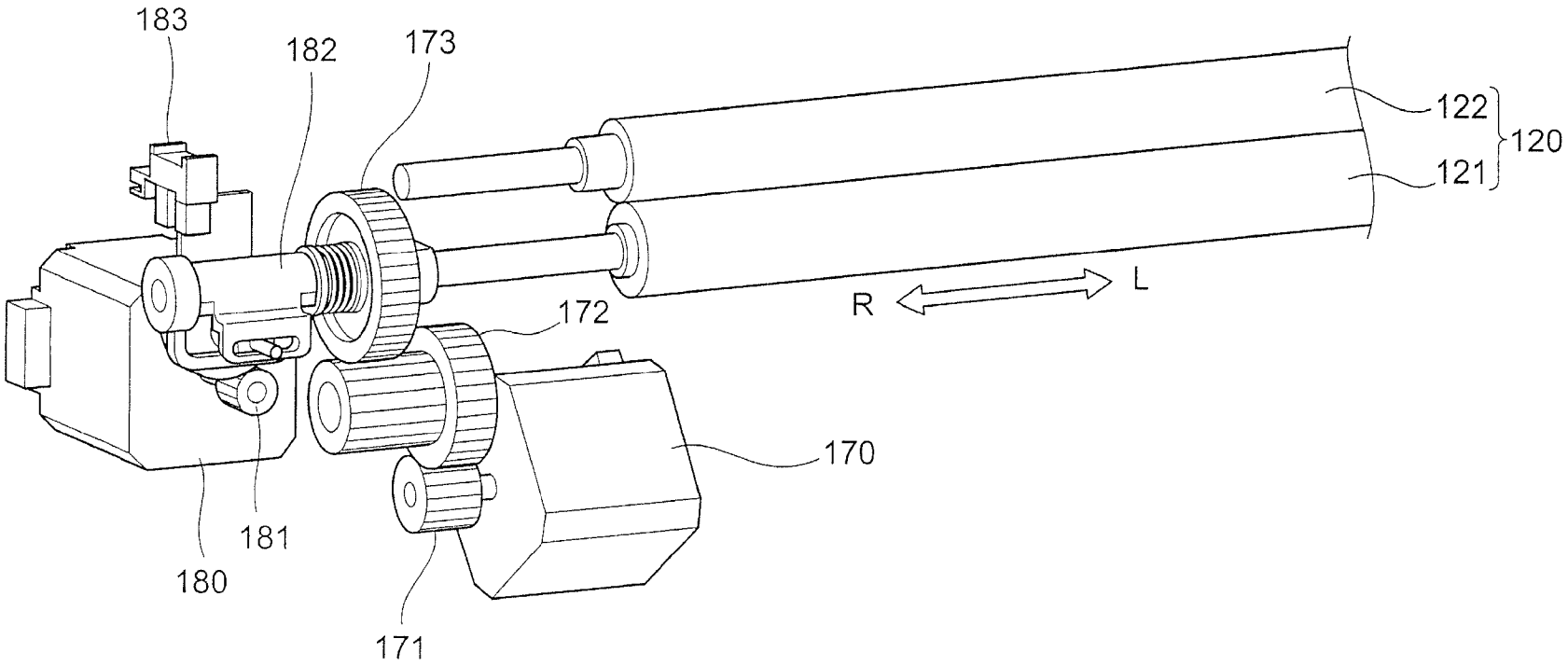
FIG. 4 is a perspective view of a principal portion of the orientation correcting device.

FIG. 2 is a side view of the orientation correcting device 100. FIG. 3 is a perspective view of the orientation correcting device 100. FIG. 4 is a perspective view of a principal portion of the orientation correcting device 100. Here, FIG. 2 illustrates the orientation correcting device 100 as viewed from the front as with FIG. 1. FIG. 3 illustrates the orientation correcting device 100 as viewed from the front and from an upstream side in a transport direction A of a sheet P. FIG. 4 illustrates the orientation correcting device 100 as viewed from the front and from a downstream side in the transport direction A of a sheet P.

Here, in the orientation correcting device 100, the direction towards the left as viewed from the transport direction A of a sheet P (that is, from the front to rear of the image forming apparatus 1 shown in FIG. 1) is called a leftward direction L, and the direction towards the right as viewed from the transport direction A of a sheet P (that is, from the rear to the front of the image forming apparatus 1 shown in FIG. 1) is called a rightward direction R. The leftward direction L and the rightward direction R correspond to crossing directions.

The orientation correcting device 100 includes a pre-registration roller pair 110, a registration roller pair 120, a sheet guide 130, a sheet detecting unit 140, a lift arm 150, a pre-registration motor 160, a registration motor 170, and a side shift motor 180.

The pre-registration roller pair 110, serving as an exemplary first transporting unit, is disposed at an upstream side in the transport direction A as viewed from the registration roller pair 120. The pre-registration roller pair 110 includes a first pre-registration roller 111 and a second pre-registration roller 112. The first pre-registration roller 111 and the second pre-registration roller 112 are each rotatable, and oppose each other so as to be in contact with each other.

Here, the first pre-registration roller 111 is disposed at a lower side of a transport path of a sheet P. The first pre-registration roller 111 includes a metallic shaft and rubber roller members mounted on the shaft. The second pre-registration roller 112 is disposed at an upper side of the transport path of a sheet P. The second pre-registration roller 112 also includes a metallic shaft and rubber roller members mounted on the shaft. Here, the second pre-registration roller 112 is pushed against the first pre-registration roller 111 by a coil spring mounted on the shaft of the second pre-registration roller 112.

The pre-registration motor 160 is connected to an end portion of the first pre-registration roller 111 in the leftward direction L. By this, the first pre-registration roller 111 is rotationally driven by rotation of the pre-registration motor 160. The second pre-registration roller 112 that contacts the first pre-registration roller 111 is rotationally driven by the rotationally driving of the first pre-registration roller 111.

The registration roller pair 120, serving as an exemplary second transporting unit, is disposed at a downstream side in the transport direction A as viewed from the pre-registration roller pair 110. The registration roller pair 120 includes a first registration roller 121 and a second registration roller 122. The first registration roller 121 and the second registration roller 122 are each rotatable, and oppose each other so as to be in contact with each other.

Here, the first registration roller 121 is disposed at the lower side of the transport path of a sheet P. The first registration roller 121 includes a metallic shaft and rubber roller members mounted on the shaft. The second registration roller 122 is disposed at the upper side of the transport path of a sheet P. The second registration roller 122 also includes a metallic shaft and rubber roller members mounted on the shaft.

The registration motor 170 is connected to an end portion of the first registration roller 121 in the rightward direction R through a first driving gear 171, a second driving gear 172, and a third driving gear 173. Here, the first driving gear 171 is mounted on a shaft of the registration motor 170. The third driving gear 173 is mounted on the shaft of the first registration roller 121. The second driving gear 172 includes two gears that have different diameters and that are integrated with each other. The gear having the larger diameter engages with the first driving gear 171. The gear having the smaller diameter engages with the third driving gear 173. By this, the first registration roller 121 is rotationally driving through the first driving gear 172 to the third driving gear 173 by rotation of the registration motor 170. The second registration roller 122 that contacts the first registration roller 121 is rotationally driven by the rotational driving of the first registration roller 121.

A first connecting portion 121*a* including two annular members is mounted on an end portion of the first registration roller 121 in the leftward direction L. A second connecting portion 122*a* including a roller member is mounted on an end portion of the second registration roller 122 in the leftward direction L. In this exemplary embodiment, the second connecting portion 122*a* of the second registration roller 122 is inserted between portions of the first connecting portion 121*a* of the first registration roller 121.

The side shift motor 180 is connected to the end portion of the first registration roller 121 in the rightward direction R through a pinion gear 181 and a rack gear 182. Here, the pinion gear 181 is mounted on a shaft of the side shift motor 180. The rack gear 182 is mounted on the shaft of the first registration roller 121. By this, the first registration roller 121 is driven in an axial direction (that is, the leftward direction L or the rightward direction R) through the pinion gear 181 and the rack gear 182 by rotation of the side shift motor 180. At this time, the second registration roller 122 also moves in an axial direction (that is, the leftward direction L or the rightward direction R) through the first connecting portion 121*a* of the first registration roller 121 and the second connecting portion 122*a* of the second registration roller 122. That is, in response to the rotation of the side shift motor 180, the first registration roller 121 and the second registration roller 122 of the registration roller pair 120 move (are side-shifted) together in an axial direction.

A position detecting sensor 183 that detects the position of the first registration roller 121 (the registration roller pair 120) in the axial directions (that is, the leftward direction L and the rightward direction R) through the rack gear 182 is mounted above the rack gear 182.

The sheet guide 130 forms the transport path of a sheet P. The sheet guide 130 includes a lower guide 131 and an upper guide 132.

Here, the lower guide 131 is formed from a metallic plate that has been, for example, bent, and is disposed at the lower side of the transport path. The first pre-registration roller 111 and the first registration roller 121 are disposed at the side of the lower guide 131. The upper guide 132 is also formed from a metallic plate that has been, for example, bent, and is disposed at the upper side of the transport path. The second pre-registration roller 112 and the second registration roller 122 are disposed at the side of the upper guide 132.

The transport path of a sheet P is formed between the lower guide 131 and the upper guide 132. A space for accommodating a loop (flexure) of a sheet P is formed in a substantially central portion of the transport path in the transport direction A.

The sheet detecting unit 140, serving as an exemplary detecting unit, detects the passage of a sheet P that is being transported in the transport direction A. The sheet detecting unit 140 includes a left detecting sensor 141 and a right detecting sensor 142. The left detecting sensor 141 and the right detecting sensor 142 are each mounted on the upper guide 132.

Here, the left detecting sensor 141 is disposed on the left when viewed from a center position (that is, a center reference position) in a width direction of a sheet P that is orthogonal to the transport direction A in the transport path. In contrast, the right detecting sensor 142 is disposed on the right when viewed from the center reference position. The left detecting sensor 141 and the right detecting sensor 142 are each an optical sensor.

The lift arm 150 vertically moves the second pre-registration roller 112 of the pre-registration roller pair 110. The lift arm 150 includes a shaft and an arm section. The shaft of the lift arm 150 is rotatably mounted on the upper guide 132. The arm section is mounted on the shaft and is disposed so as to contact the shaft of the second pre-registration roller 112. A lift motor (not shown) is connected to an end portion of the lift arm 150 in the leftward direction L. By this, rotation of the lift motor causes the lift arm 150 to be rotationally driven, so that the second pre-registration roller 112 is lifted against a pushing force of the coil spring, as a result of which the first pre-registration roller 111 and the second pre-registration roller 112 are brought out of contact with each other. Rotation of the lift motor in the reverse direction causes the lift arm 150 to be rotationally driven in the opposite direction, so that the second pre-registration roller 112 is pushed down by a pushing force of the coil spring, as a result of which the first pre-registration roller 111 and the second pre-registration roller 112 are brought into contact with each other.

Figure 5:
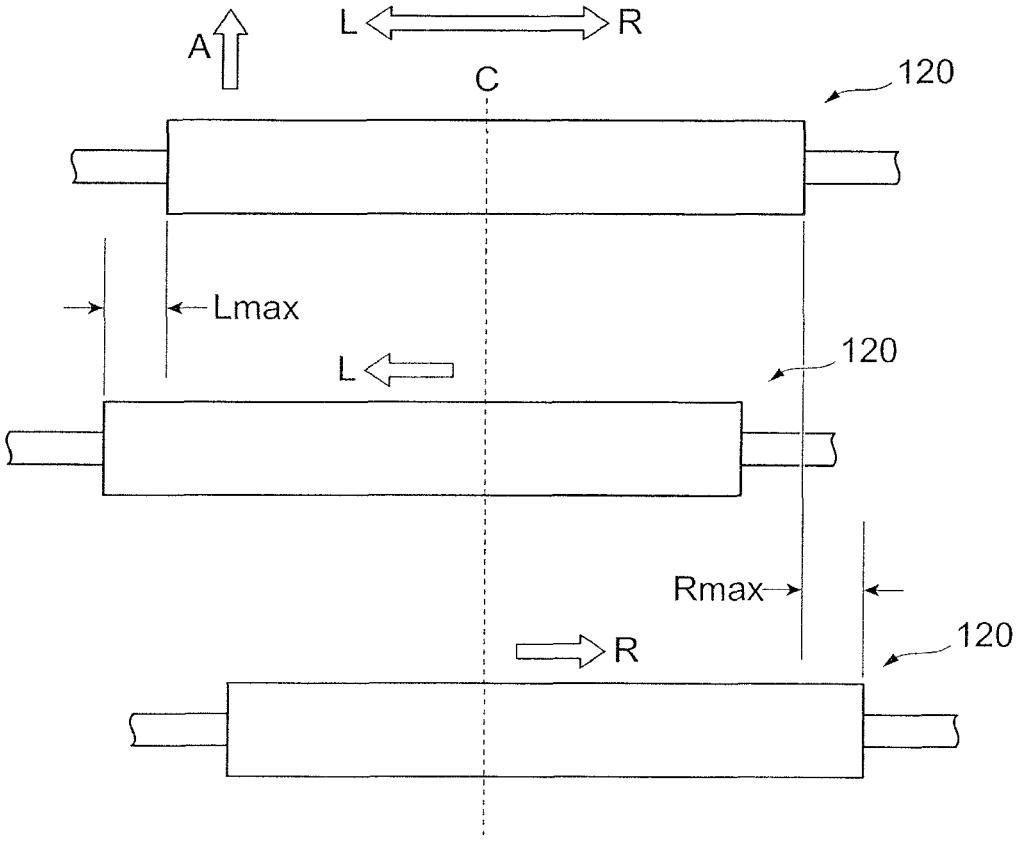
FIG. 5 illustrates side shifts of a registration roller pair.

FIG. 5 illustrates side shifts (that is, movements in the axial directions) of the registration roller pair 120 of the orientation correcting device 100. In FIG. 5, a center reference position C corresponds to the center position (the center reference) in a width direction that is orthogonal to the transport direction A of a sheet P (not shown) that is transported in the transport direction A.

First, the upper illustration in FIG. 5 shows the registration roller pair 120 disposed in a reference state. In the reference state, a center position of the registration roller pair 120 in the axial directions coincides with the center reference position C.

Next, the middle illustration in FIG. 5 shows the registration roller pair 120 disposed in a leftmost state achieved by maximally moving the registration roller pair 120 in the leftward direction L from the reference state shown in the upper illustration. In the leftmost state, the center position of the registration roller pair 120 in the axial directions is shifted by a maximum leftward shift amount Lmax in the leftward direction L from the center reference position C. In this exemplary embodiment, the maximum leftward shift amount Lmax is 7.0 mm (+7.0 mm).

The lowest illustration in FIG. 5 shows the registration roller pair 120 disposed in a rightmost state achieved by maximally moving the registration roller pair 120 in the rightward direction R from the reference state shown in the upper illustration. In the rightmost state, the center position of the registration roller pair 120 in the axial directions is shifted by a maximum rightward shift amount Rmax in the rightward direction R from the center reference position C. In this exemplary embodiment, the maximum rightward shift amount Rmax is 7.0 mm (−7.0 mm).

Accordingly, the registration roller pair 120 according to the exemplary embodiment is movable in a range of 14.0 mm in the axial directions thereof. By setting the reference state at the center of the registration roller pair 120, the registration roller pair 120 is movable in the range of ±7.0 mm in the axial directions.

Figure 6:
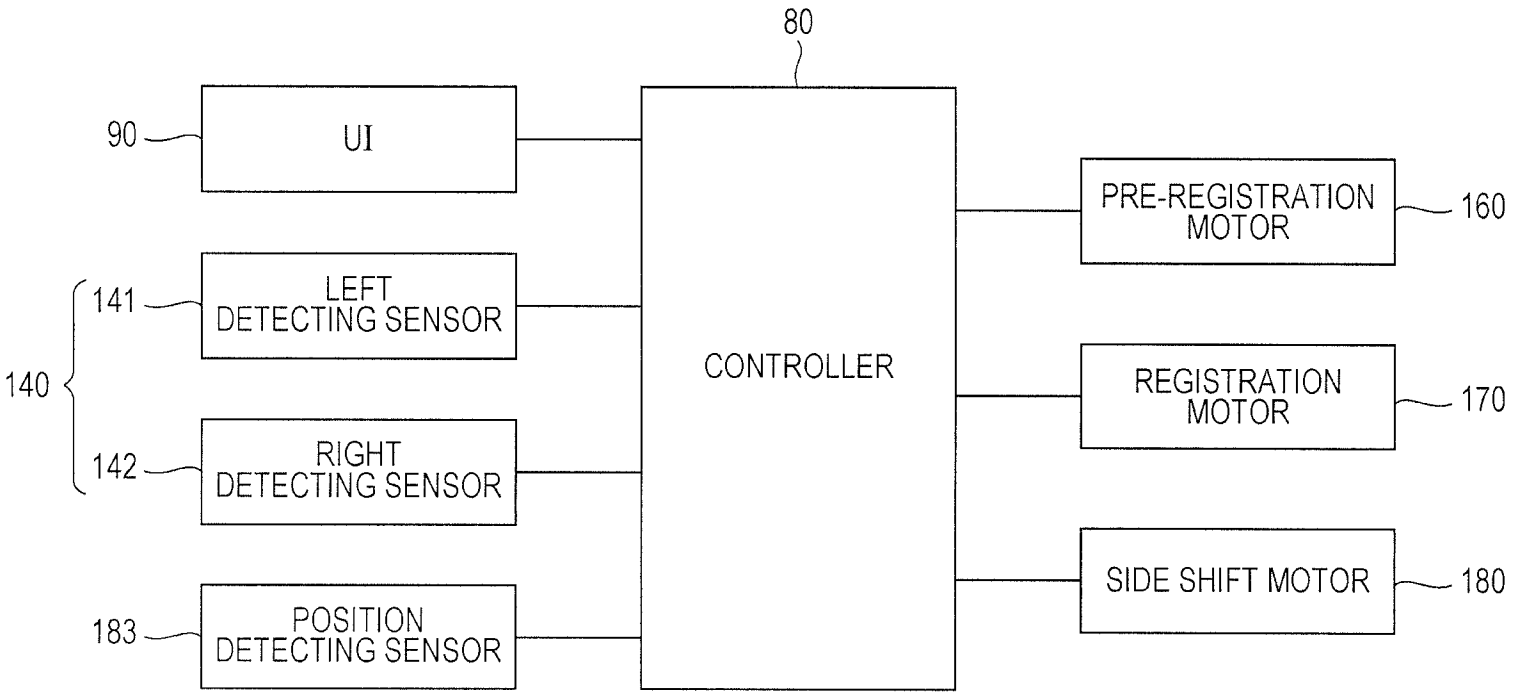
FIG. 6 is a control block diagram regarding correction of orientation.

FIG. 6 is a control block diagram regarding correction of orientation in the image forming apparatus 1 according to the exemplary embodiment.

Various image formation conditions (such as a one side/two-side mode) are input from the UI 90 to the controller 80 serving as an example of a flexure forming unit, a moving unit, a starting unit, a limiting unit, and a canceling unit. In addition, sheet-P detection results are input to the controller 80 from the left detecting sensor 141 and the right detecting sensor 142 of the sheet detecting unit 140. Further, a position detection result of the rack gear 182 (the registration roller pair 120) is input to the controller 80 from the position detecting sensor 183. The controller 80 outputs control signals to the pre-registration motor 160, the registration motor 170, and the side shift motor 180.

Next, the operation of the orientation correcting device 100 according to the exemplary embodiment is described.

Figure 7:
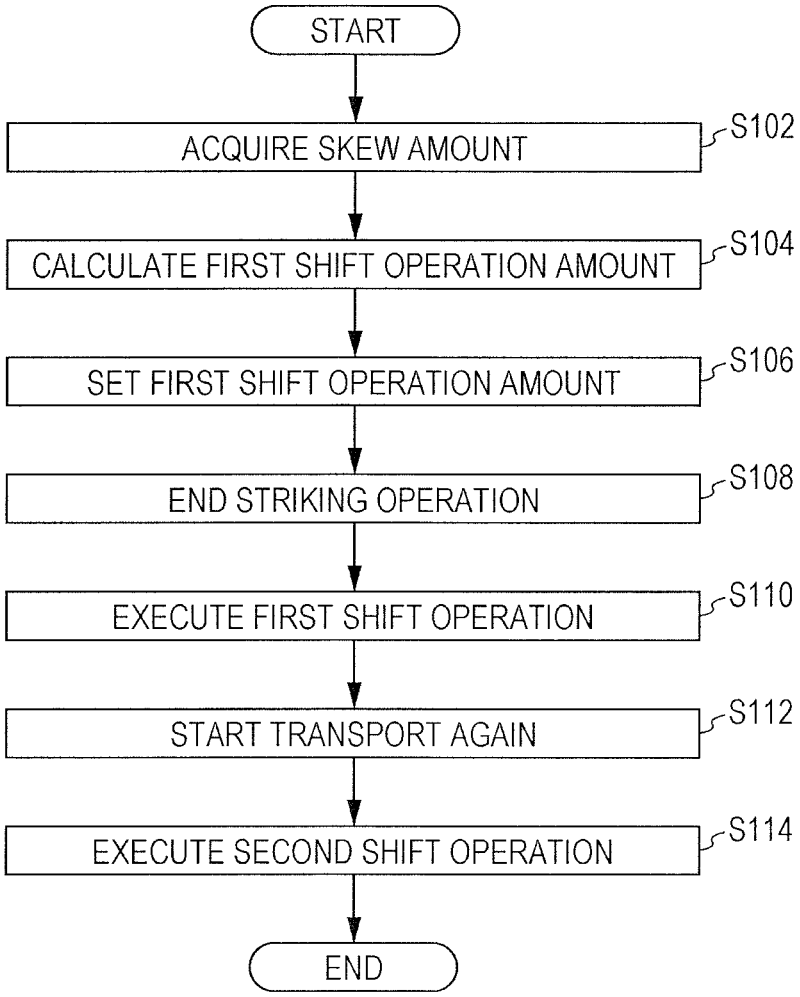
FIG. 7 is a flowchart of a procedure for correcting orientation in a first exemplary embodiment.

FIG. 7 is a flowchart of a procedure for correcting orientation in the first exemplary embodiment.

In an initial state, the pre-registration roller pair 110 are set in a nipping state in which the first pre-registration roller 111 and the second pre-registration roller 112 are set in contact with each other. In the initial state, the pre-registration roller pair 110 are set in a non-rotated state. In the initial state, the registration roller pair 120 are set in the reference state shown in the upper illustration in FIG. 5. In the initial state, the registration roller pair 120 are set in a non-rotated state.

First, the controller 80 outputs a control signal to the pre-registration motor 160. This causes the pre-registration motor 160 to start operating, so that the pre-registration roller pair 110 start to rotate. At this time, the registration roller pair 120 remain in the non-rotated state.

Then, a sheet P is transported into the orientation correcting device 100 through the first transport path R1. A leading end of the sheet P in the transport direction A passes the sheet detecting unit 140. Then, a result of detection by the left detecting sensor 141 of the sheet detecting unit 140 and a result of detection by the right detecting sensor 142 of the sheet detecting unit 140 are input to the controller 80. At this time, in accordance with a skew state of the sheet P, a timing of detection of the sheet P by the left detecting sensor 141 and a timing of detection of the sheet P by the right detecting sensor 142 differ from each other.

Next, on the basis of the results of detections by the left detecting sensor 141 and the right detecting sensor 142, more specifically, on the basis of the difference between the timings of detections by the sensors, the controller 80 acquires a skew amount of the sheet P that is being transported (Step S102). Here, the controller 80 has a table in which the amounts of difference between the timing of detection by the left detecting sensor 141 and the timing of detection by the right detecting sensor 142 and the skew amounts of sheets P are given in correspondence with each other. From this table, the skew amount of the sheet P is acquired.

At this time, with information regarding the type of sheet P (ordinary sheet, thick sheet, thin sheet) that is transported in the orientation correcting device 100 being received from, for example, the UI 90, the skew amount of the sheet P may be acquired from a table in which the amounts of difference between the detection timings, received information regarding types of sheets P, and skew amounts of sheets P are given in correspondence with each other.

Next, from the skew amount acquired in Step S102, the controller 80 calculates a first shift operation amount, which corresponds to the distance in which the registration roller pair 120 is moved in an axial direction (Step S104). Here, in the exemplary embodiment, a shift operation amount in the leftward direction L from the reference state shown in the upper illustration in FIG. 5 is a positive value, whereas a shift operation amount in the rightward direction R from the reference state is a negative value.

Next, the controller 80 outputs the first shift operation amount calculated in Step S104 to the side shift motor 180, and the side shift motor 180 sets the received first shift operation amount (Step S106).

While the operations from Step S102 to Step S106 are executed, the leading end in the transport direction A of the sheet P that is transported by the pre-registration roller pair 110 reaches a nip (that is, a contact portion between the first registration roller 121 and the second registration roller 122) of the registration roller pair 120 that are not rotating. After the leading end of the sheet P in the transport direction A strikes the registration roller pair 120, with a loop (flexure) formed in the sheet P, the controller 80 outputs a control signal to the pre-registration motor 160, and causes the pre-registration motor 160 to stop operating. This causes the pre-registration roller pair 110 to stop rotating, as a result of which the striking of the sheet P against the registration roller pair 120 ends (Step S108). By this, the skew of the sheet P is corrected.

In a state in which the pre-registration roller pair 110 and the registration roller pair 120 are in the non-rotated state, the side shift motor 180 executes a first shift operation to move the registration roller pair 120 in an axial direction (that is, in either the leftward direction L or the rightward direction R) on the basis of the first shift operation amount that has been set in Step S106 (Step S110). This causes the skew of the sheet P to be further corrected. After the first shift operation has been executed in Step S110, the controller 80 outputs a control signal to the registration motor 170. The registration motor 170 starts operating, so that the registration roller pair 120 starts rotating. By this, the transport of the sheet P is started again (Step S112). After nipping the sheet P by the registration roller pair 120 as a result of starting the rotation of the registration roller pair 120, the controller 80 outputs a control signal to the lift motor (not shown). This causes the lift arm 150 to start rotating. As a result, the second pre-registration roller 112 of the pre-registration roller pair 110 is lifted, so that the nipping by the pre-registration roller pair 110 is stopped.

Then, the controller 80 further outputs a control signal to the side shift motor 180. This causes the side shift motor 180 to execute a second shift operation to move the registration roller pair 120 in an axial direction (that is, in either the leftward direction L or the rightward direction R) on the basis of a second shift operation amount (Step S114). Here, the second shift operation amount is set for causing a center position in a width direction that is orthogonal to the transport direction A of the sheet P that is being transported to coincide with the center reference position C of the transport path. By this, with the skew corrections and the side registration correction having been performed on the sheet P, the sheet P is transported towards the second transfer device 30.

Then, after the sheet P has passed through the orientation correcting device 100 and before the next sheet P enters the orientation correcting device 100, the rotational driving of the registration roller pair 120 is stopped, and the registration roller pair 120 is returned to the reference position. In addition, the pre-registration roller pair 110 is set again in a nipping state. As a result, the orientation correcting device 100 is returned to its initial state. Accordingly, the operations are completed.

FIGS. 8A to 8F illustrate the procedure for correcting orientation in the first exemplary embodiment.

Figure 8A:
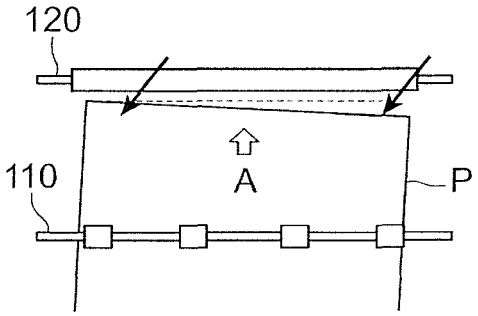
FIGS. 8A to 8F illustrate the procedure for correcting orientation in the first exemplary embodiment.

First, FIG. 8A illustrates a state in which a leading end of a sheet P that is transported by the rotating pre-registration roller pair 110 is detected by the sheet detecting unit 140 (not shown) before the leading end reaches the registration roller pair 120 that are not rotating. In the example shown in FIG. 8A, the sheet P is assumed as being transported in a skewed state in which the left side of the sheet P is sloped with respect to the right side of the sheet P (that is, the sheet P is tilted towards the right). In this case, the leading end of the sheet P that is transported is first detected by the left detecting sensor 141, and is subsequently detected by the right detecting sensor 142. At this time, the difference between the timing of detection by the left detecting sensor 141 and the timing of detection by the right detecting sensor 142 (that is, the time) is increased as the skew angle of the sheet P is increased.

Figure 8D:
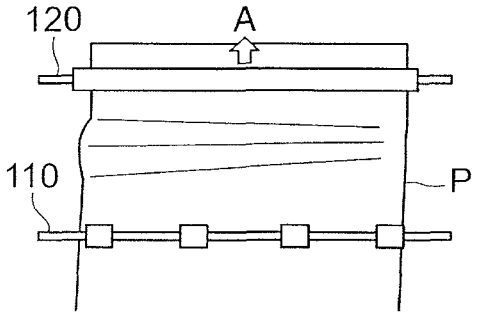
Figure 8B:
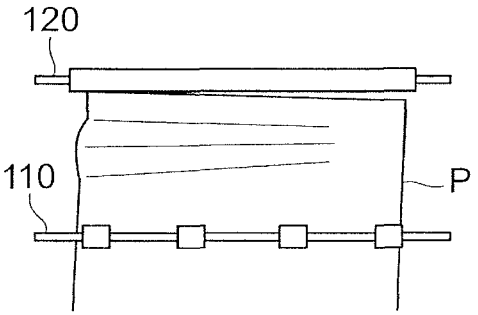

FIG. 8B illustrates a state in which the leading end (here, the leading left end portion) of the sheet P that is transported by the rotating pre-registration roller pair 110 has struck the nip of the registration roller pair 120 that are not rotating. In this state, a loop (that is, a flexure) is formed in the sheet P as a result of the leading end of the sheet P that is transported by the pre-registration roller pair 110 striking against the nip of the registration roller pair 120 that are not rotating. This causes the skew of the sheet P to be corrected.

Here, while the state shown in FIG. 8A changes to the state shown in FIG. 8B, Steps S102 to S106 shown in FIG. 7 are executed. After the state shown in FIG. 8A has changed to the state shown in FIG. 8B, Step S108 shown in FIG. 7 is executed.

Figure 8E:
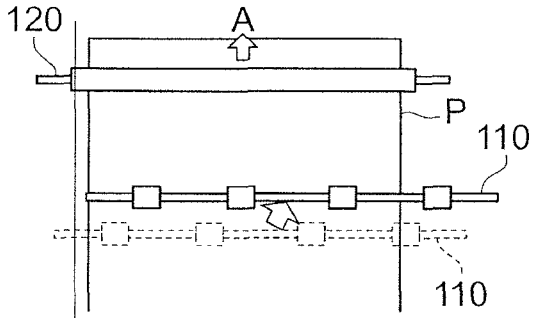
Figure 8C:
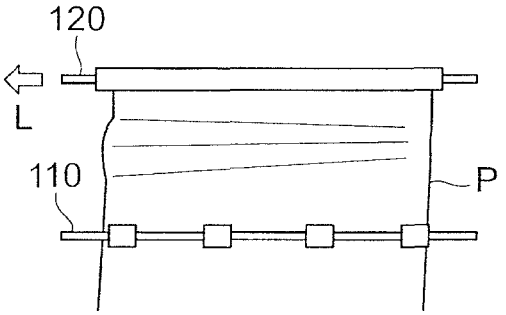

FIG. 8C illustrates a state in which the registration roller pair 120 is side-shifted by the first shift operation amount in the leftward direction L while the pre-registration roller pair 110 and the registration roller pair 120 are not rotating. In this example, as shown in FIG. 8A etc., the sheet P is skewed towards the right. Therefore, in Step S104, the direction of the first shift operation is determined so as to move the sheet P that is tilted towards the right towards the left. In addition, in Step S104, the distance of the first shift operation is determined in accordance with the skew angle of the sheet P, that is, the amount of difference between the timing of detection by the left detecting sensor 141 and the timing of detection by the right detecting sensor 142. The direction and the distance of the first shift operation are calculated as the first shift operation amount in Step S104. The obtained first shift operation amount is set in Step S106, and is used in the first shift operation in Step S110. By this, as shown in FIG. 8C, the entire leading end of the sheet P contacts the nip of the registration roller pair 120, and the skew of the sheet P is further corrected.

FIG. 8D illustrates a state where Step S112 shown in FIG. 7 is executed, that is, a state in which the transport of the sheet P is started again by starting the rotation of the registration roller pair 120 subjected to the first shift operation in Step S110. In this state, although the pre-registration roller pair 110 are not rotating, since a loop is still formed in the sheet P, this does not interfere with the transport by the registration roller pair 120. In the state shown in FIG. 8D, the leading end in the transport direction A of the sheet P that is discharged from the registration roller pair 120 is in a state in which its skew is corrected.

FIG. 8E illustrates a state in which the nipping of the pre-registration roller pair 110 is stopped by operating the lift arm 150 after re-starting the transport of the sheet P by the registration roller pair 120. This removes the loop formed in the sheet P. In this state, since the sheet P is nipped by the registration roller pair 120, there is no change in the orientation (skew corrected state) of the sheet P that is discharged from the registration roller pair 120.

Figure 8F:
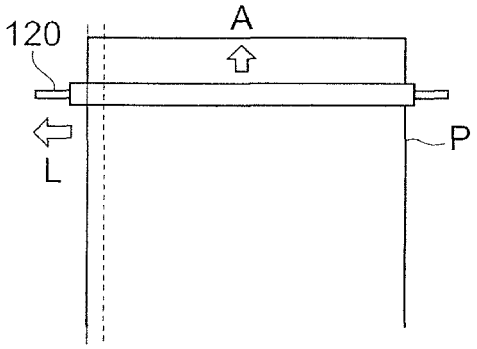

FIG. 8F illustrates a state after Step S114 shown in FIG. 7 is executed, that is, a state after the second shift operation has been executed for causing the center position in a width direction that is orthogonal to the transport direction A of the sheet P to coincide with the center reference position C (see FIG. 5) by further side-shifting the registration roller pair 120 after stopping the nipping by the pre-registration roller pair 110. In this example, the sheet P is moved further in the leftward direction L. By this, in addition to correcting the skew of the sheet P, the position of the sheet P in a width direction is capable of being corrected (that is, side registration correction is capable of being performed).

Second Exemplary Embodiment

In the first exemplary embodiment, correction of the skew of a sheet P that makes use of side shifting of the registration roller pair 120 is performed by using the first shift operation amount calculated from the skew amount of the sheet P as it is. In contrast, in a second exemplary embodiment, a maximum value is provided for the first shift operation amount.

In the second exemplary embodiment and third to fifth exemplary embodiments described below, corresponding parts to those according to the first exemplary embodiment are given the same reference numerals, and are not described in detail below.

Figure 9:
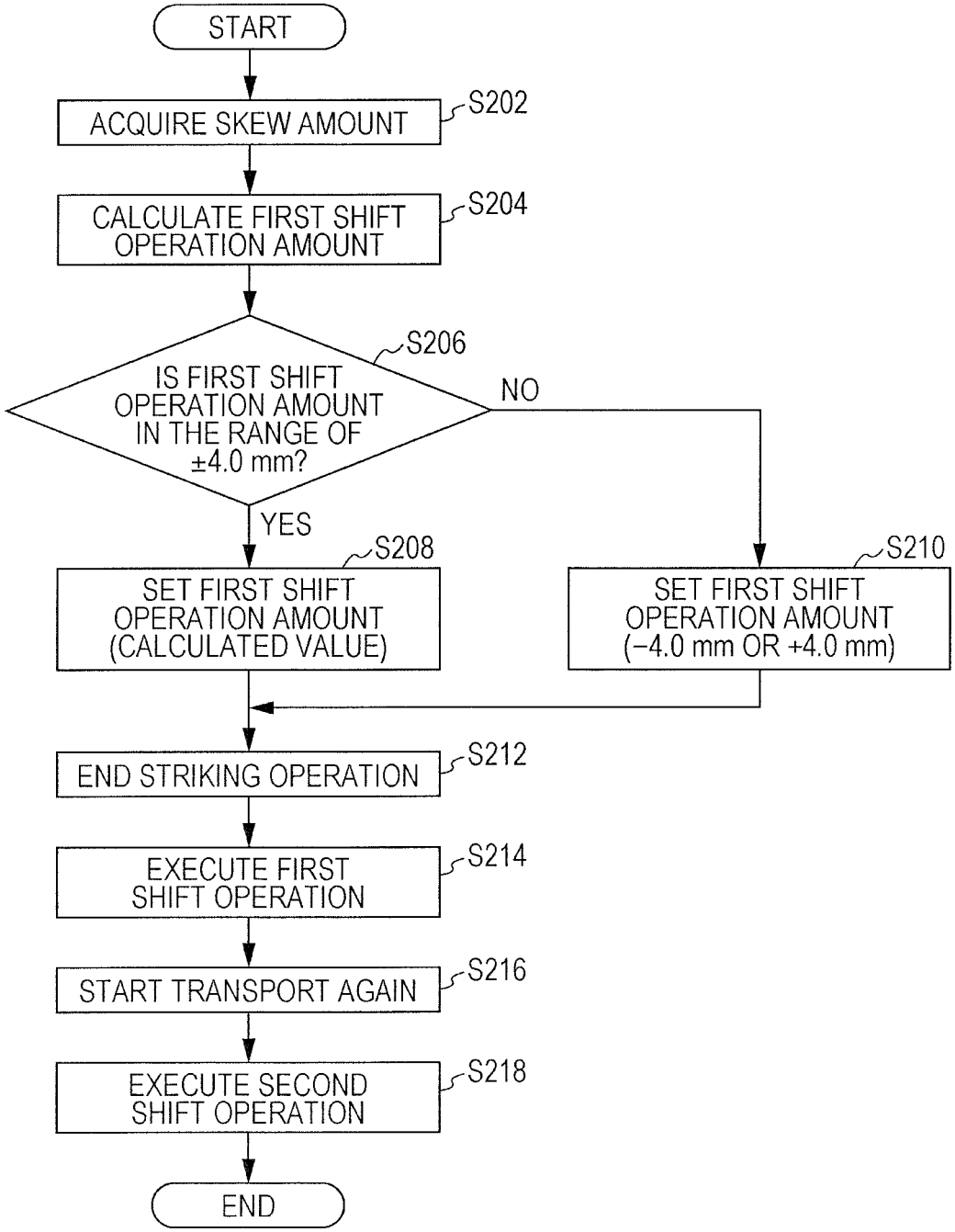
FIG. 9 is a flowchart of a procedure for correcting orientation in a second exemplary embodiment.

FIG. 9 is a flowchart of a procedure for correcting orientation in the second exemplary embodiment. Here, the setting of an initial state of the orientation correcting device 100 is the same as that in the first exemplary embodiment. This also applies to the third to fifth exemplary embodiments described below.

The controller 80 acquires a skew amount of a sheet P that is being transported (Step S202), and a first shift operation amount is calculated from the acquired skew amount (Step S204). The content of Step S202 and the content of Step S204 are the same as that of Step S102 and that of Step S104 shown in FIG. 7, respectively.

Next, the controller 80 determines whether or not the first shift operation amount calculated in Step S204 is in the range of ±4.0 mm (Step S206). If the controller 80 determines that the first shift operation amount is in the range of ±4.0 mm in Step S206, the controller 80 outputs the calculated value obtained in Step S204 as the first shift operation amount to the side shift motor 180. Then, the side shift motor 180 sets the received first shift operation amount (that is, the calculated value) (Step S208). In contrast, if the controller 80 determines that the first shift operation amount is outside the range of ±4.0 mm in Step S206, the controller 80 changes the calculated value obtained in Step S204 to −4.0 mm (in the case of the rightward direction R) or +4.0 mm (in the case of the leftward direction L), which are maximum values, and outputs the changed value as the first shift operation amount to the side shift motor 180. Then, the side shift motor 180 sets the received first shift operation amount (−4.0 mm or +4.0 mm) (Step S210).

Next, striking of the sheet P against the registration roller pair 120 ends (Step S212). The content of Step S212 is the same as that of Step S108 shown in FIG. 7.

Then, in a state in which the pre-registration roller pair 110 and the registration roller pair 120 are not rotating, the side shift motor 180 executes a first shift operation to move the registration roller pair 120 in an axial direction on the basis of the first shift operation amount that has been set in Step S208 or Step S210 (Step S214). The content of Step S214 is basically the same as that of Step S110 shown in FIG. 7. However, if the controller 80 has determined that the calculated first shift operation amount is in the range of ±4.0 mm in Step S206, the first shift operation amount is the calculated value, whereas, if the controller 80 has determined that the calculated first shift operation amount is outside the range of ±4.0 mm in Step S206, the first shift operation amount is limited to +4.0 mm or −4.0 mm.

Thereafter, the transport of the sheet P is started again (Step S216), and a second shift operation is further executed (Step S218). The content of Step S216 and the content of Step S218 are the same as that of Step S112 and that of Step S114 shown in FIG. 7, respectively.

Third Exemplary Embodiment

In the second exemplary embodiment, a maximum value is provided for the first shift operation amount. In contrast, in a third exemplary embodiment, a maximum value is provided for a first shift operation time, which corresponds to the time taken for performing a first shift operation.

Figure 10:
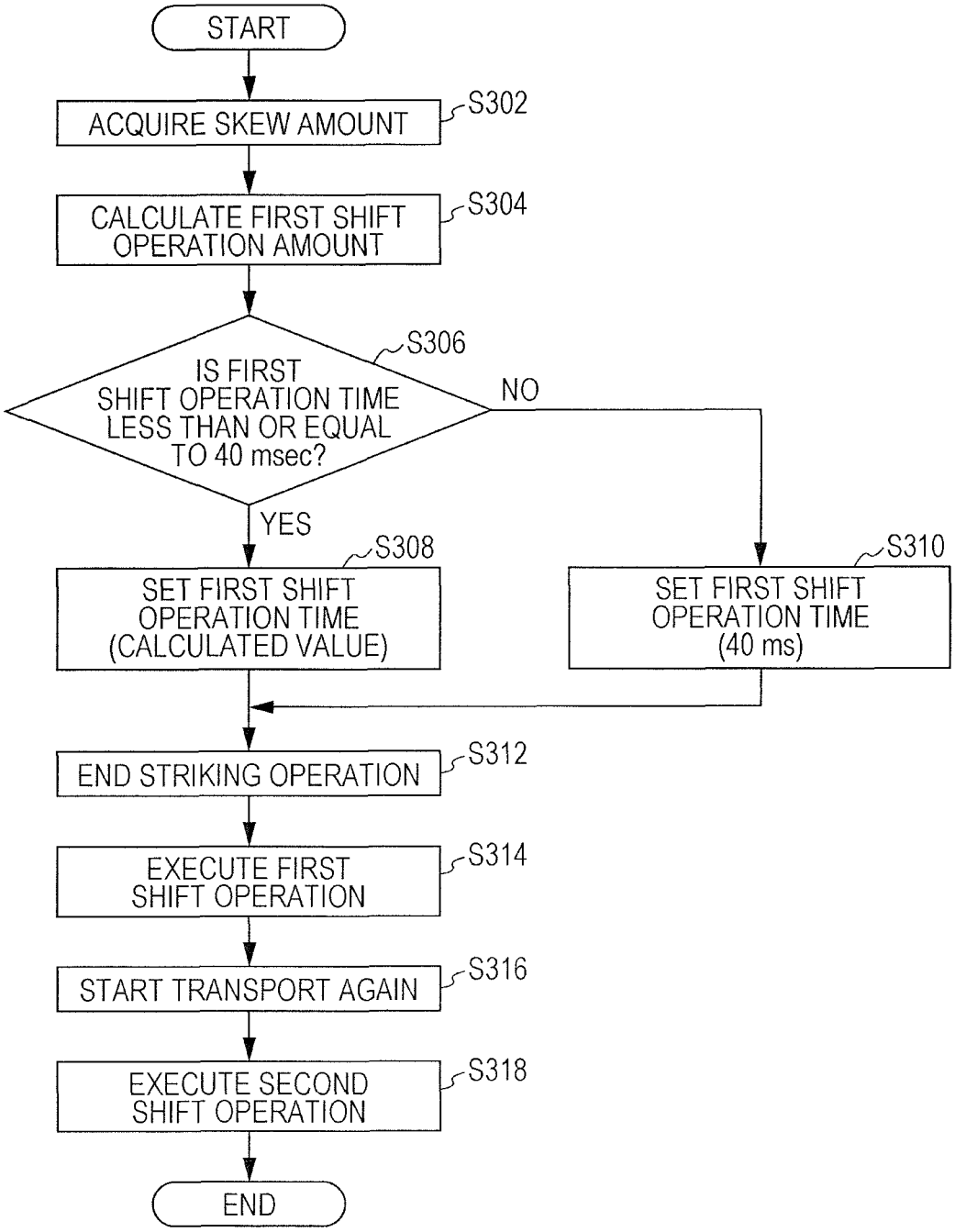
FIG. 10 is a flowchart of a procedure for correcting orientation in a third exemplary embodiment.

FIG. 10 is a flowchart of a procedure for correcting orientation in the third exemplary embodiment.

The controller 80 acquires a skew amount of a sheet P that is being transported (Step S302). The content of Step S302 is the same as the content of Step S102 shown in FIG. 7.

Next, the controller 80 calculates a first shift operation amount, which is a distance for moving the registration roller pair 120 in an axial direction, from the skew amount acquired in Step S302. Then, on the basis of the obtained first shift operation amount and a movement speed when the registration roller pair 120 is side-shifted, the controller 80 calculates a first shift operation time, which is the time taken for moving the registration roller pair 120 by the first shift operation amount (Step S304).

Next, the controller 80 determines whether or not the first shift operation time calculated in Step S304 is less than or equal to 40 msec (Step S306). If the controller 80 determines that the first shift operation time is less than or equal to 40 msec in Step S306, the controller 80 outputs the calculated value obtained in Step S304 as the first shift operation time to the side shift motor 180. Then, the side shift motor 180 sets the received first shift operation time (that is, the calculated value) (Step S308). In contrast, if the controller 80 determines that the first shift operation time is not less than or equal to 40 msec in Step S306, the controller 80 changes the calculated value obtained in Step S304 to 40 msec (which is the maximum value), and outputs the changed value as the first shift operation time to the side shift motor 180. Then, the side shift motor 180 sets the received first shift operation time (40 msec) (Step S310).

Next, striking of the sheet P against the registration roller pair 120 ends (Step S312). The content of Step S312 is the same as that of Step S108 shown in FIG. 7.

Then, in a state in which the pre-registration roller pair 110 and the registration roller pair 120 are not rotating, the side shift motor 180 executes a first shift operation to move the registration roller pair 120 in an axial direction on the basis of the first shift operation time that has been set in Step S308 or Step S310 (Step S314). The content of Step S314 is basically the same as the content of Step S110 shown in FIG. 7. However, if the controller 80 has determined that the calculated first shift operation time is less than or equal to 40 msec in Step S306, the first shift operation time is the calculated value, whereas, if the controller 80 has determined that the calculated first shift operation time is not less than or equal to 40 msec in Step S306, the first shift operation time is limited to 40 msec.

Thereafter, the transport of the sheet P is started again (Step S316), and a second shift operation is further executed (Step S318). The content of Step 316 and the content of Step S318 are the same as that of Step S112 and that of Step S114 shown in FIG. 7, respectively.

Fourth Exemplary Embodiment

In each of the first to third exemplary embodiments, the first shift operation is performed on the registration roller pair 120 that are set in the reference state. In contrast, in a fourth exemplary embodiment, considering the second shift operation that is executed after executing the first shift operation, the first shift operation is executed while previously shifting (pre-shifting) the registration roller pair 120 that has been set in the reference state in a direction opposite to that of the first shift operation.

Figure 11:
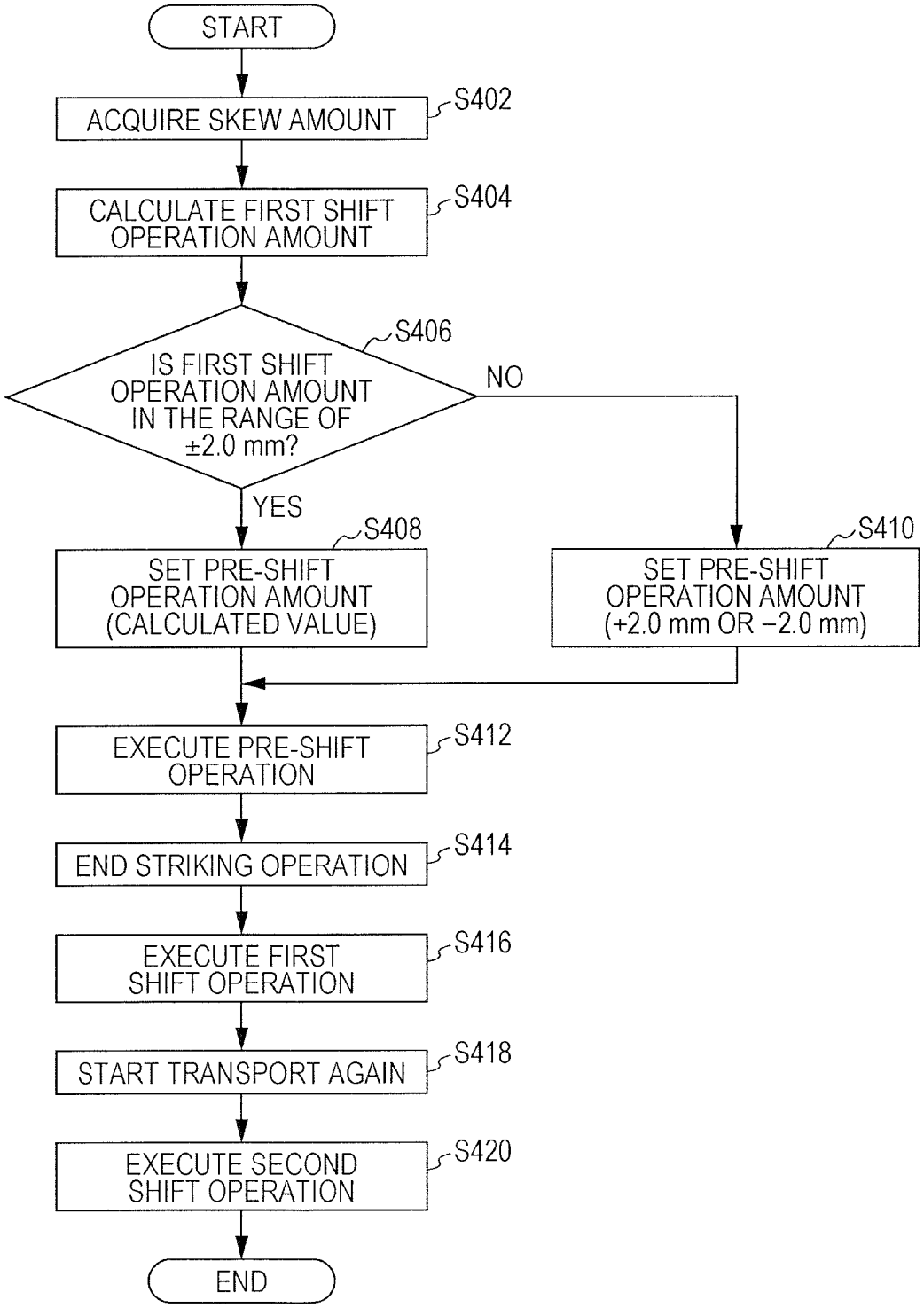
FIG. 11 is a flowchart of a procedure for correcting orientation in a fourth exemplary embodiment.

FIG. 11 is a flowchart of a procedure for correcting orientation in the fourth exemplary embodiment.

A controller 80 acquires a skew amount of a sheet P that is being transported (Step S402), and a first shift operation amount is calculated from the acquired skew amount (Step S404). The content of Step S402 and the content of Step S404 are the same as that of Step S102 and that of Step S104 shown in FIG. 7, respectively.

Next, the controller 80 determines whether or not the first shift operation amount calculated in Step S404 is in the range of ±2.0 mm (Step S406). If the controller 80 determines that the first shift operation amount is in the range of ±2.0 mm in Step S406, the controller 80 outputs the calculated value obtained in Step S404 as a pre-shift operation amount to the side shift motor 180. Then, the side shift motor 180 sets the received pre-shift operation amount (that is, the calculated value) (Step S408). In contrast, if the controller 80 determines that the first shift operation amount is outside the range of ±2.0 mm in Step S406, the controller 80 changes the calculated value obtained in Step S404 to −2.0 mm (in the case of the leftward direction L) or +2.0 mm (in the case of the rightward direction R), which are maximum values, and outputs the changed value as the pre-shift operation amount to the side shift motor 180. Then, the side shift motor 180 sets the received pre-shift operation amount (−2.0 mm or +2.0 mm) (Step S410).

Next, the side shift motor 180 executes a pre-shift operation to move the registration roller pair 120 in an axial direction on the basis of the pre-shift operation amount that has been set in Step S408 or Step S410 (Step S412). Here, the direction of movement of the registration roller pair 120 in the pre-shift operation is opposite to the direction of the first shift operation (described below). That is, when the first shift operation is set in the leftward direction L, the pre-shift operation is set in the rightward direction R; whereas, when the first shift operation is set in the rightward direction R, the pre-shift operation is set in the leftward direction L.

Next, striking of the sheet P against the registration roller pair 120 ends (Step S414), and the first shift operation is executed on the registration roller pair 120 on the basis of the first shift operation amount calculated in Step S404 (Step S416). Thereafter, the transport of the sheet P is started again (Step S418), and the second shift operation is executed (Step S420). The content of Step S414, the content of Step S416, the content of Step S418, and the content of Step S420 are the same as that of Step S108, that of Step S110, that of Step S112, and that of Step S114 shown in FIG. 7, respectively.

Fifth Exemplary Embodiment

In each of the first to fourth exemplary embodiments, the first shift operation is executed regardless of the skew amount of a sheet P. In contrast, in a fifth exemplary embodiment, if the skew amount of a sheet P is too large (in the case where an abnormality has occurred), the execution of the first shift operation is stopped.

Figure 12:
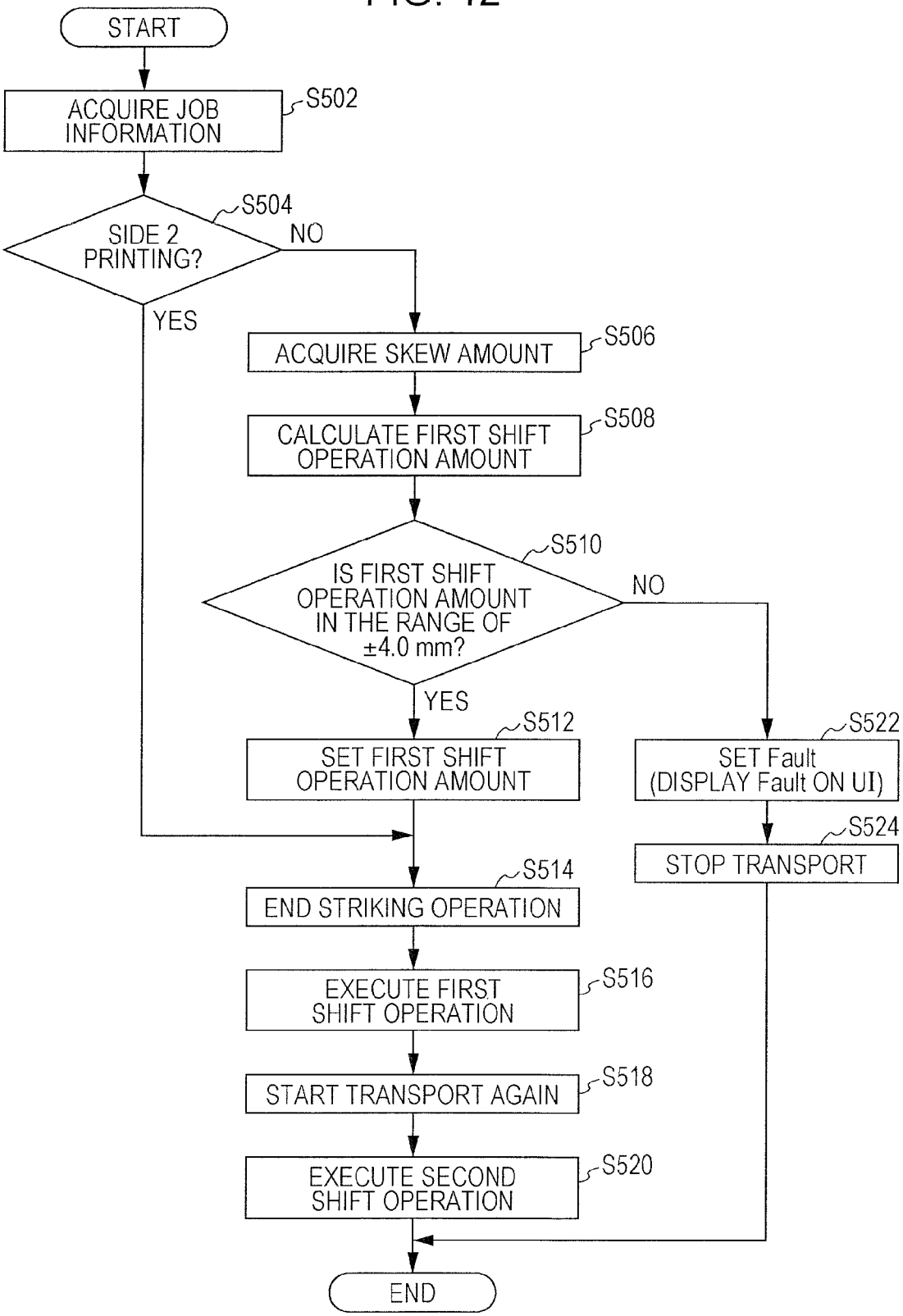
FIG. 12 is a flowchart of a procedure for correcting orientation in a fifth exemplary embodiment.

FIG. 12 is a flowchart of a procedure for correcting orientation in the fifth exemplary embodiment.

In this procedure, first, the controller 80 acquires information regarding a job to be executed from the UI 90 (Step S502). Then, from this, the controller 80 determines whether or not a sheet P that is being transported into the orientation correcting device 100 corresponds to a second surface (that is, Side 2) to be printed in two-side printing (Step S504). If the controller 80 determines that the sheet P corresponds to a second surface to be printed in two-side printing in Step S504, the process proceeds to Step S514 (described below).

In contrast, if the controller 80 determines that the sheet P does not correspond to a second surface to be printed in two-side printing in Step S504, the controller 80 acquires a skew amount of the sheet P that is being transported (Step S506), and calculates a first shift operation amount from the acquired skew amount (Step S508). The content of Step S506 and the content of Step S508 are the same as that of Step S102 and that of Step S104 shown in FIG. 7, respectively.

Next, the controller 80 determines whether or not the first shift operation amount calculated in Step S508 is in the range of ±4.0 mm (Step S510). If the controller 80 determines that the first shift operation amount is in the range of ±4.0 mm in Step S510, the controller 80 outputs the calculated value obtained in Step S508 as the first shift operation amount to the side shift motor 180. Then, the side shift motor 180 sets the received first shift operation amount (Step S512).

Next, striking of the sheet P against the registration roller pair 120 ends (Step S514), and the first shift operation is executed on the registration roller pair 120 on the basis of the first shift operation amount calculated in Step S508 (Step S516). Thereafter, the transport of the sheet P is started again (Step S518), and a second shift operation is executed (Step S520). The content of Step S514, the content of Step S516, the content of Step S518, and the content of Step S520 are the same as that of Step S108, that of Step S110, that of Step S112, and that of Step S114 shown in FIG. 7, respectively.

In contrast, if the controller 80 determines that the first shift operation amount is outside the range of ±4.0 mm in Step S510, the controller 80 sets "Fault", which means that an error has occurred, and displays this on the UI 90 (Step S522). Then, the transport of the sheet P in the orientation correcting device 100 is canceled (Step S524), and the operations are completed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An orientation correcting device comprising:

a first transporter configured to nip and transport a sheet;

a detector configured to detect a tilt of the sheet that is transported by the first transporter;

a second transporter configured to nip and transport the sheet that has been transported by the first transporter, the second transporter provided at a location that is downstream from the first transporter in a transport direction of the sheet;

a controller configured to control rotation of the first and second transporters to form a flexure in the sheet by causing the sheet that is transported by the first transporter to strike against the second transporter, with the second transporter being stopped by control of the controller when the sheet strikes the second transporter;

a transporter shifter configured to move the second transporter in a crossing direction that crosses the transport direction of the sheet in accordance with an amount and a direction of the sheet tilt detected by the detector, with the second transporter being stopped by the controller and the sheet having the flexure formed in the sheet by the controller, a starter, with the second transporter being stopped and the flexure formed in the sheet by the controller, configured to control the second transporter to start transporting the sheet after the transporter shifter has moved the second transporter while nipping the sheet, in the crossing direction to a first position, wherein, after the starter controls the second transporter to transport the sheet, the transporter shifter is configured to start moving the second transporter while nipping the sheet, in the crossing direction from the first position, and wherein in response to the starter controlling the second transporter to transport the sheet, the controller controls the first transporter to disengage from the sheet.

2. The orientation correcting device according to claim 1, wherein the transporter shifter moves the second transporter in the crossing direction from the first position based on a type of the sheet.

3. The orientation correcting device according to claim 1, further comprising a limiter, when a movement amount of the second transporter in the crossing direction determined in accordance with the amount and the direction of the sheet tilt detected by the detector passes a predetermined maximum value, configured to limit the movement amount to the maximum value.

4. The orientation correcting device according to claim 2, further comprising a limiter, when a movement amount of the second transporter in the crossing direction determined in accordance with the amount and the direction of the sheet tilt detected by the detector passes a predetermined maximum value, configured to limit the movement amount to the maximum value.

5. The orientation correcting device according to claim 1, wherein the transporter shifter moves the second transporter in a direction that is opposite to an intended direction in accordance with the amount and the direction of the sheet tilt detected by the detecting unit before the sheet reaches the second transporter, and moves the second transporter in the intended direction after the sheet has reached the second transporter.

6. The orientation correcting device according to claim 2, wherein the transporter shifter moves the second transporter in a direction that is opposite to an intended direction in accordance with the amount and the direction of the sheet tilt detected by the detecting unit before the sheet reaches the second transporter, and moves the second transporter in the intended direction after the sheet has reached the second transporter.

7. The orientation correcting device according to claim 1, further comprising a canceling unit that cancels the transport of the sheet when the amount of the sheet tilt detected by the detecting unit exceeds a predetermined threshold value.

8. The orientation correcting device according to claim 2, further comprising a canceling unit that cancels the transport of the sheet when the amount of the sheet tilt detected by the detecting unit exceeds a predetermined threshold value.

9. An image forming apparatus comprising:

a first transporter configured to nip and transport a sheet;

a detector configured to detect a tilt of the sheet that is transported by the first transporter;

a second transporter configured to nip and transport the sheet that has been transported by the first transporter, the second transporter provided at a location that is downstream from the first transporter in a transport direction of the sheet;

an image former configured to form an image on the sheet that is transported by the second transporter;

a controller, with the second transporter being stopped, configured to control rotation of the first and second transporters to form a flexure in the sheet by causing the sheet that is transported by the first transporter to strike against the stopped second transporter;

a transporter shifter, with the second transporter being stopped and the flexure formed in the sheet by the controller, configured to move the second transporter in a crossing direction that crosses the transport direction of the sheet based on an amount and a direction of the tilt of the sheet detected by the detector;

a starter, with the second transporter being stopped by the controller and the flexure formed in the sheet by the controller, configured to control the second transporter to start transporting the sheet after the transporter shifter has moved the second transporter while nipping the sheet, in the crossing direction to a first position;

wherein, after the starter controls the second transporter to transport the sheet, the transporter shifter is configured to start moving the second transporter while nipping the sheet, in the crossing direction from the first position, and wherein in response to the starter controlling the second transporter to transport the sheet, the controller controls the first transporter to disengage from the sheet.

* * * * *